US007334599B2

(12) United States Patent
Shieh

(10) Patent No.: US 7,334,599 B2
(45) Date of Patent: Feb. 26, 2008

(54) SINGLE LEVER FAUCET WITH SPRAY

(75) Inventor: Ming-Dang Shieh, Lu Kang (TW)

(73) Assignee: Horng Lai Industrial Co., Ltd., Changhua (TW)

( * ) Notice: Subject to any disclaimer, the term of this patent is extended or adjusted under 35 U.S.C. 154(b) by 170 days.

(21) Appl. No.: 11/307,605

(22) Filed: Feb. 14, 2006

(65) Prior Publication Data

US 2007/0186975 A1 Aug. 16, 2007

(51) Int. Cl.
*G05D 11/00* (2006.01)

(52) U.S. Cl. ..... 137/119.05; 137/119.09; 137/597; 137/613; 137/801

(58) Field of Classification Search ..... 137/119.03, 137/119.04, 119.05, 119.09, 315.12, 597, 137/613, 625.17
See application file for complete search history.

(56) References Cited

U.S. PATENT DOCUMENTS 3,736,959 A * 6/1973 Parkison ..... 137/625.17
4,008,732 A * 2/1977 Fichter et al. ..... 137/119.04
4,301,972 A * 11/1981 Rudelick ..... 239/443
5,349,987 A * 9/1994 Shieh ..... 137/801
5,881,754 A * 3/1999 Wei ..... 137/119.04
5,937,905 A * 8/1999 Santos ..... 137/871
2004/0011399 A1* 1/2004 Segien, Jr. ..... 137/119.01
2007/0012361 A1* 1/2007 Shien ..... 137/119.05

* cited by examiner

*Primary Examiner*—Ramesh Krishnamurthy
(74) *Attorney, Agent, or Firm*—Alan Kamrath; Kamrath & Associates PA

(57) ABSTRACT

A single lever faucet with spray, wherein two cold and hot water inlet holes, a water outlet hole and a through hole are defined in the bottom of the faucet body, and the water outlet hole is connected to a hollow threaded tube, and the through hole is connected to a connecting tube. One side of the peripheral of the faucet body is defined with a chamber and a controlling device, and in the top surface of the faucet body is formed an inserting groove that is connected to the through hole for inserting a discharging base. A tee joint member is mounted between the hollow threaded tube and the connecting tube, a valve room is defined in the tee joint member for installing a diverter valve, and the middle section of the tee joint member is connected to the hollow threaded tube, and the ends are connected to a spray gun and a guiding tube respectively. Therefore, by opening and closing the spray gun, the water that supplied to the spray gun and the water outlet tube can be changed automatically.

2 Claims, 7 Drawing Sheets

SINGLE LEVER FAUCET WITH SPRAY

BACKGROUND OF THE INVENTION

1. Field of the Invention

The present invention relates to a faucet, and more particularly to a single lever faucet with spray, wherein a diverter valve is mounted outside a faucet body.

2. Description of the Prior Art

A conventional lever faucet is usually used in the bath and kitchen facility for providing a suitable water temperature, and the cold and hot water is controlled by a lever. When connecting a spray gun to the lever faucet, another lever is needed to operate the water that discharged from the water outlet tube or the spray gun, such arrangement is inconvenient, and due to the gravity of the lever or the water pressure, the lever is likely to be switched back automatically to turn on the faucet, making the water flow from the faucet.

Therefore, a chamber is formed in the lever faucet for connecting to the water outlet tube and the spray gun, and a diverter valve is mounted in the chamber that can be changed automatically according to the change of the hydraulic pressure of the spray gun, thereby users can cut off the water outlet tube when opening the spray gun without operating any changing member, contrarily, when closing the spray gun the water will be discharged from the water outlet tube.

Since the diverter valve is mounted in the lever faucet, the above-mentioned lever faucet is difficult to assemble and high cost, and the diverter valve cannot be cleaned and changed easily when it is accumulated with impurities or damaged after a long period of use.

The present invention has arisen to mitigate and/or obviate the afore-described disadvantages.

SUMMARY OF THE INVENTION

The primary objective of the present invention is to provide a single lever faucet with spray, which comprises a faucet body, a controlling device, a discharging base, a tee joint member and a spray gun. Two cold and hot water inlet holes, a water outlet hole and a through hole are defined in the bottom of the faucet body, and the cold and hot water inlet holes are connected to two cold and hot water inlet tubes respectively, the water outlet hole is connected to a hollow threaded tube, and the through hole is connected to a connecting tube. One side of the peripheral of the faucet body is defined with a chamber that is connected to the cold and hot water inlet holes and the water outlet hole, and in the top surface of the faucet body is formed a inserting groove that is connected to the through hole. The controlling device is mounted in the chamber of the faucet body, including a lever, a cover, a sleeve and a controlling valve. The discharging base is inserted into the inserting groove, and a discharging tube is extended from the upper end of the discharging base. A valve room is defined in the tee joint member for installing a diverter valve, and in the middle section of the tee joint member is disposed a water inlet joint which is connected to the hollow threaded tube. A first and second water outlet joint are disposed at the ends of the tee joint member respectively, the first water outlet joint is connected to the lower end of the connecting tube, and the second water outlet joint is connected to a guiding tube of the spray gun.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
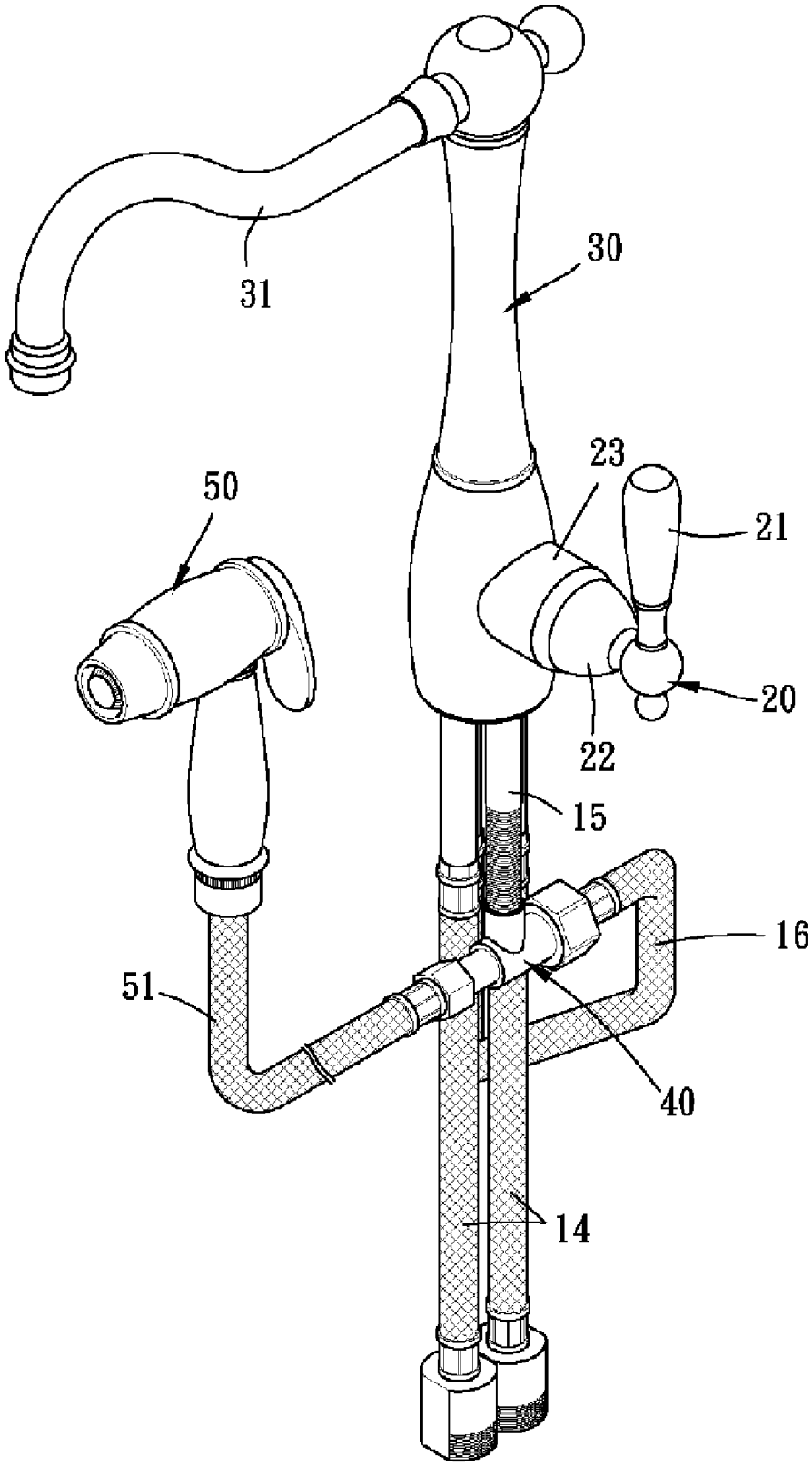
FIG. 1 is a perspective view of a lever faucet in accordance with the present invention.
Figure 2:
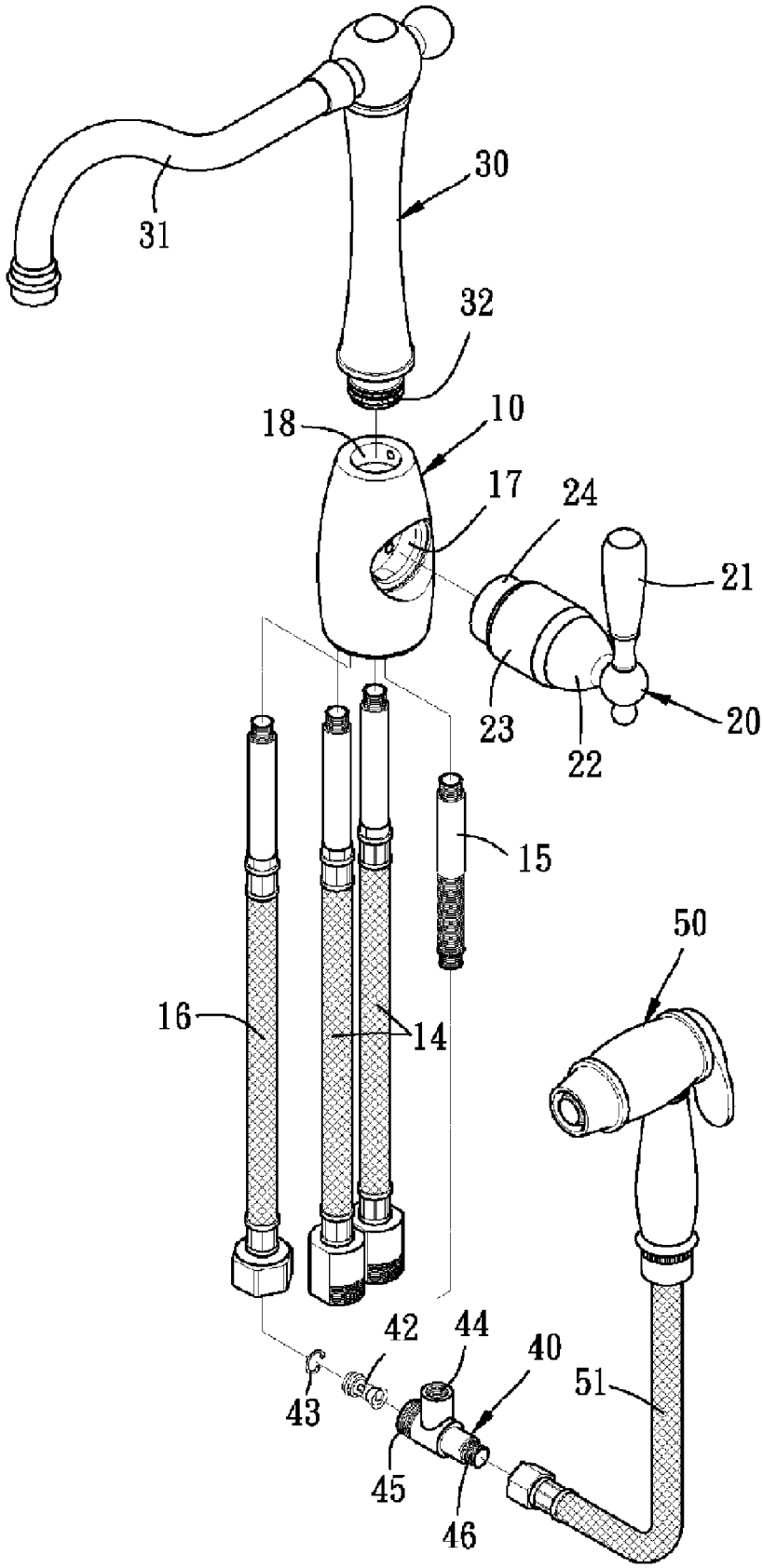
FIG. 2 is an exploded view of the lever faucet in accordance with the present invention.
Figure 3:
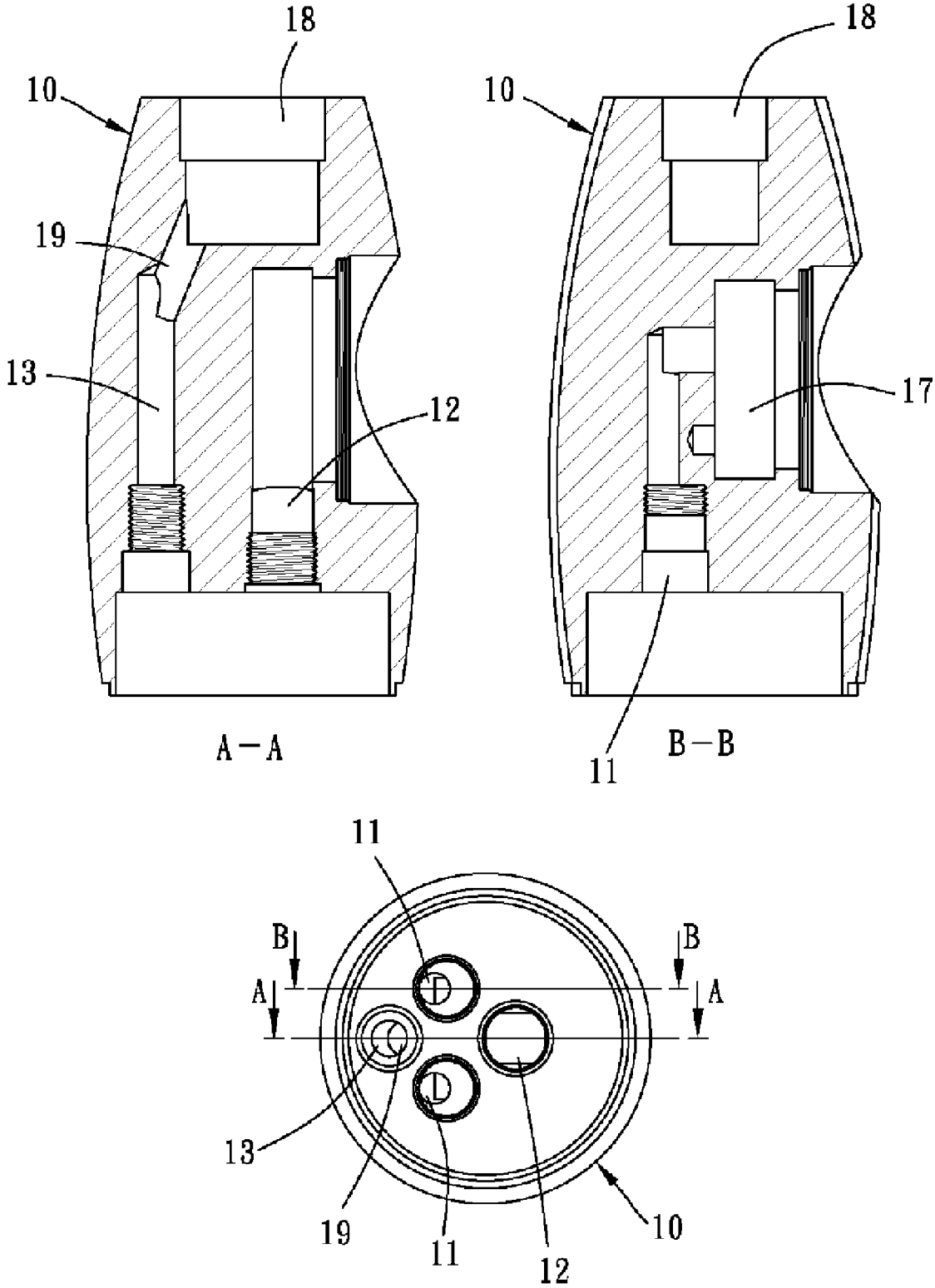
FIG. 3 is a cross sectional view of a faucet body in accordance with the present invention.
Figure 4:
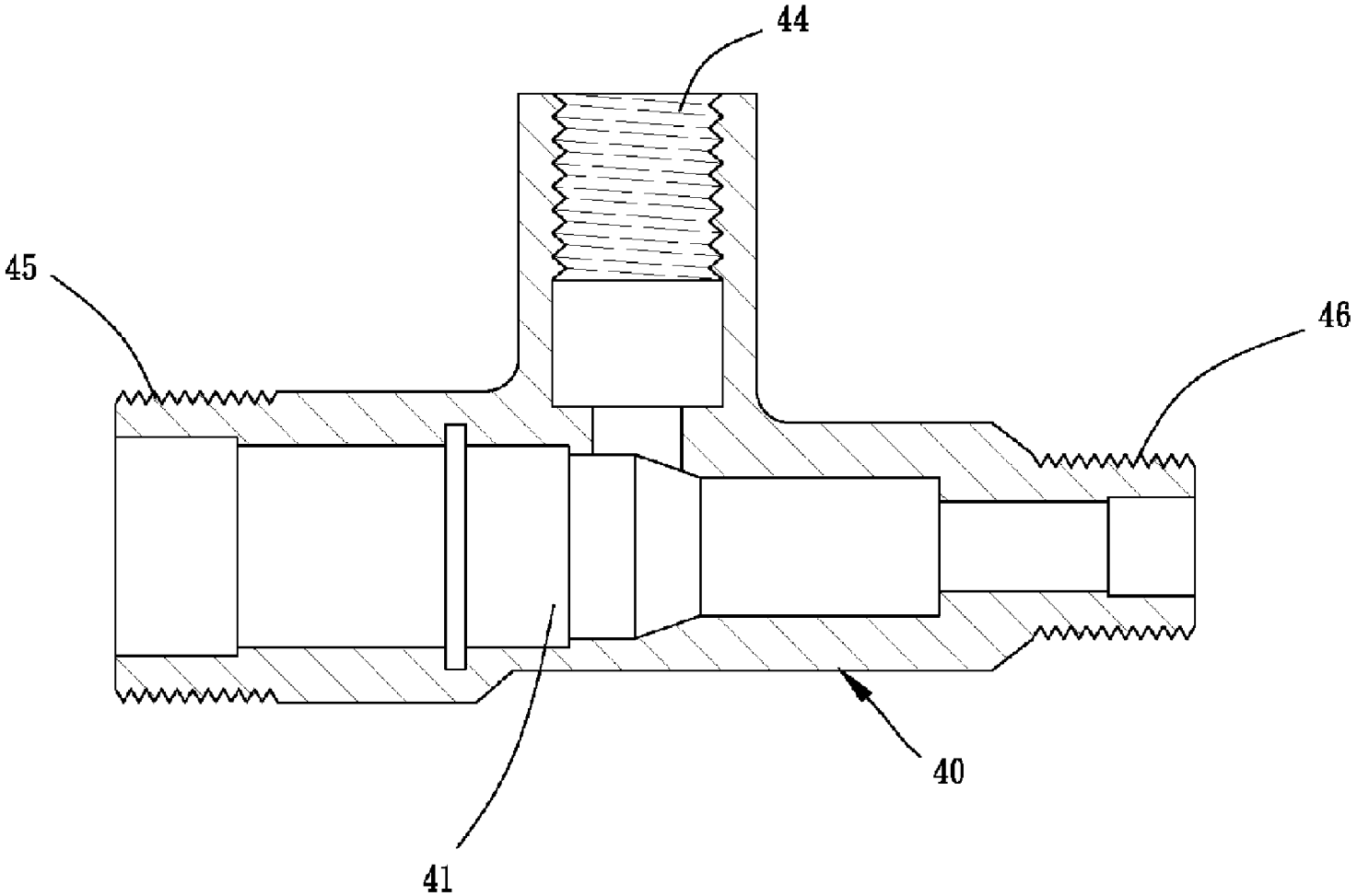
FIG. 4 is a cross sectional view of a tee joint member in accordance with the present invention.

Referring to FIGS. 1-4, a lever faucet in accordance with the present invention comprises a faucet body 10, a controlling device 20, a discharging base 30, a tee joint member 40 and a spray gun 50. The faucet body 10 is formed in the shape of an arc column 3, two cold and hot water inlet holes 11, a water outlet hole 12 and a through hole 13 are defined in the bottom of the faucet body 10. A lower end of the cold and hot water inlet holes 11 is connected to two cold and hot water inlet tubes 14, the lower end of the water outlet hole 12 is connected to a hollow threaded tube 15, and the lower end of the through hole 13 is connected to a connecting tube 16. One side of the peripheral of the faucet body is defined with a chamber 17 that is connected to the cold and hot water inlet holes 11 and the water outlet hole 12, and in the top surface of the faucet body 10 is formed a inserting groove 18 that is connected to the through hole 13 by a connecting hole 19. The controlling device 20 includes a lever 21, a cover 22, a sleeve 23 and a controlling valve 24. Since the sleeve 23 is fixed to the chamber 17 of the faucet body 10, the controlling valve 24 is attached to the bottom surface of the chamber 17. A bent discharging tube 31 is extended from the upper end of the discharging base 30, and formed at the lower end of the discharging base 30 is a connecting member 32 that is to be inserted into the inserting groove 18 of the faucet body 10, so that the discharging base 30 is rotatable. A valve room 41 is defined in the tee joint member 40 for installing a diverter valve 42 that is positioned by cooperating with a C-shaped ring, and in the middle section of the tee joint member 40 is disposed a water inlet joint 44 which is connected to the hollow threaded tube 15. A first and second water outlet joint 45, 46 are disposed at the ends of the tee joint member 40 respectively, the first water outlet joint 45 is connected to the lower end of the connecting tube 16, and the second water outlet joint 46 is connected to a guiding tube 51 of the spray gun 50.

Figure 5:
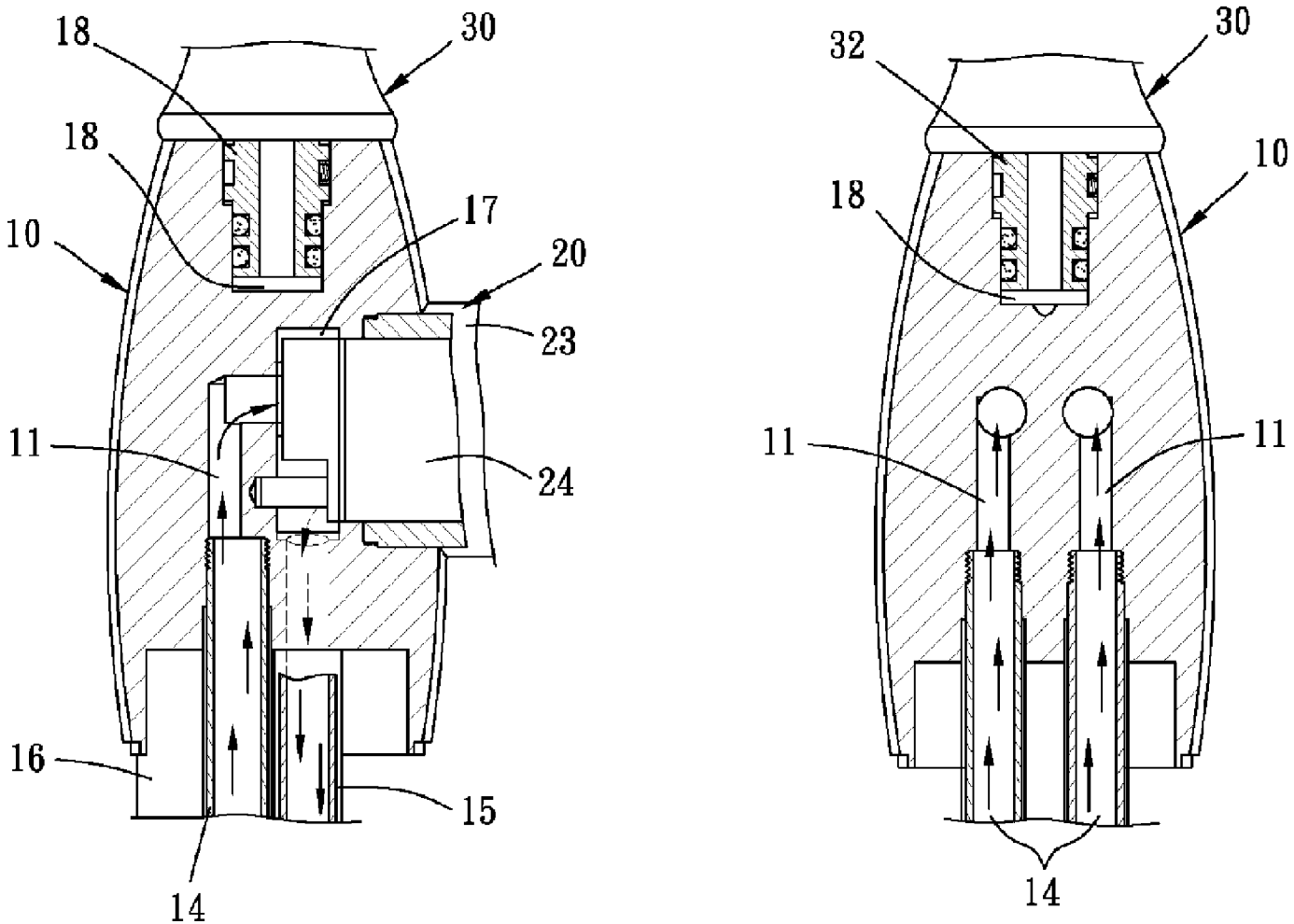
FIG. 5 is a perspective view of showing the water entering and discharging of the faucet body.
Figure 6:
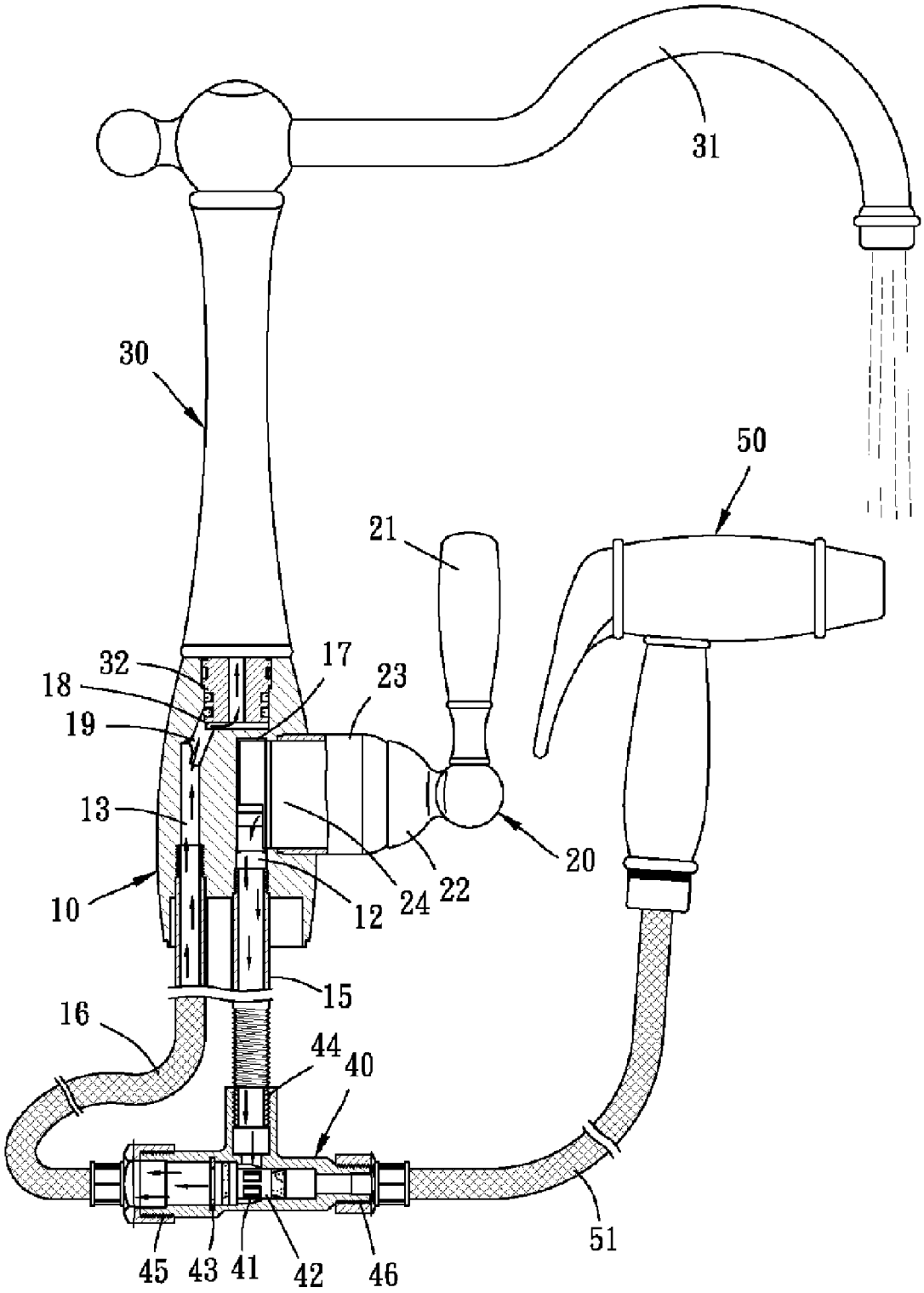
FIG. 6 is a perspective view of showing the water discharging from a water outlet tube.

Referring to FIGS. 5 and 6, when single lever faucet is used without turning on the spray gun 50, the cold water and the hot water flow from the cold and hot water inlet tubes 14 into the chamber 17 via the cold and hot water inlet holes 11 of the faucet body 10 respectively, then enter the controlling valve 24 and are mixed therein, and then flow into the tee joint member 40 from the water outlet hole 12 via the hollow threaded tube 15. At that time, since the spray gun 50 is closed, the water will pass through the diverter valve 42 and flow out of the discharging tube 31 of the discharging base 30 via the connecting tube 16, the through hole 13 and the connecting hole 19.

Figure 7:
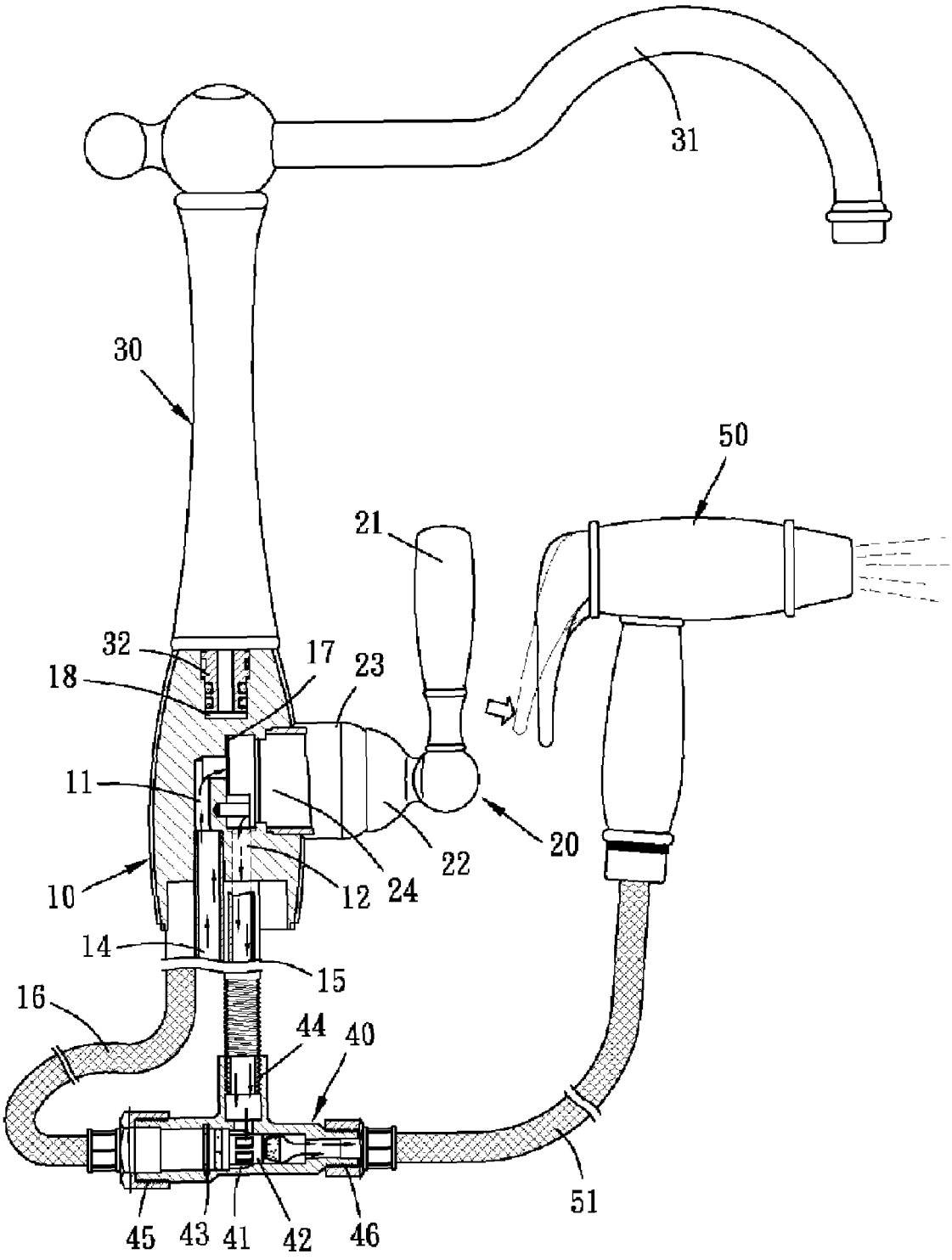
FIG. 7 is a perspective view of showing the water discharging from a spray gun.

When the spray gun 50 is turned on, as shown in FIG. 7, the cold and hot water will be mixed by the controlling valve 24 and flow from the water outlet hole 12 into the tee joint member 40 via the hollow threaded tube 15. At that time, since the spray gun 50 is opened, the water will pass through the diverter valve 42 and flow out of the spray gun 50 via the guiding tube 51, and since the hydraulic pressure of the spray gun 50 is higher than that of the discharging tube 31, the shaft of the diverter valve 42 will be displaced, thereby the passage between the diverter valve 42 and the discharging tube 31 will be blocked and the discharging tube 31 will be closed automatically.

According to the above-mentioned structure, the diverter valve 42 and the tee joint member 40 are mounted outside of the faucet body 10, such arrangement is easily assembled and low cost. Furthermore, after a long period of use, when the diverter valve 42 is accumulated with impurities or when it is damaged, the diverter valve 42 can be disassembled easily for cleaning and changing. In addition, if the user doesn't want to use the spray gun 50, the connecting tube 16 can be connected the hollow threaded tube 15 directly by removing the tee joint member 40.

While we have shown and described various embodiments in accordance with the present invention, it should be clear to those skilled in the art that further embodiments may be made without departing from the scope of the present invention.

What is claimed is:

1. A single lever faucet with spray, comprising: a faucet body having a cold water inlet hole and a hot water inlet hole defined in a bottom thereof, a cold water inlet tube and a hot water inlet tube being connected to a lower end of the cold and hot water inlet holes respectively, a chamber being defined in a side of a peripheral of the faucet body and connected to the cold and hot water inlet holes, a controlling device including a handle, a cover, a sleeve and a controlling valve installed in the chamber, an inserting groove defined in a top surface of the faucet body for insertion of a discharging base, and a water outlet tube mounted on an upper end of the discharging base; wherein a water outlet hole and a through hole are defined in the bottom of the faucet body, the water outlet hole is connected to the chamber and a hollow threaded tube, and the through hole is connected to the discharging base and a connecting tube, and a tee joint member is arranged between the hollow threaded tube and the connecting tube and is connected to a guiding tube of a spray gun.

2. The single lever faucet with spray as claimed in claim 1, wherein the through hole is connected to the inserting groove by a connecting hole.

* * * * *